US007290466B1

(12) United States Patent
Wadsley

(10) Patent No.: US 7,290,466 B1
(45) Date of Patent: Nov. 6, 2007

(54) BOLT AND NUT ENGAGING TOOL

(76) Inventor: Michael F. Wadsley, 1149 N. Reeder Ave., Covina, CA (US) 91724

( * ) Notice: Subject to any disclaimer, the term of this patent is extended or adjusted under 35 U.S.C. 154(b) by 0 days.

(21) Appl. No.: 11/681,357

(22) Filed: Mar. 2, 2007

Related U.S. Application Data

(63) Continuation of application No. 11/003,965, filed on Dec. 6, 2004, now Pat. No. 7,191,687.

(51) Int. Cl.
*B25B 13/00* (2006.01)
*B25B 13/06* (2006.01)

(52) U.S. Cl. ..... 81/124.3; 81/121.1; 81/177.1

(58) Field of Classification Search ..... 81/124.3, 81/212.1, 177.1, 177.2, 177.85; D8/25
See application file for complete search history.

(56) References Cited

U.S. PATENT DOCUMENTS

| | | | |
|---|---|---|---|
| D274,404 | S | 6/1984 | Adler |
| 5,005,448 | A | 4/1991 | Main |
| 5,287,775 | A | 2/1994 | Moore |
| D415,664 | S | 10/1999 | Rapoport et al. |
| 6,078,298 | A | 6/2000 | Planning et al. |
| 6,138,531 | A | 10/2000 | Lamons |
| 6,516,689 | B1 | 2/2003 | Bates |

*Primary Examiner*—Alvin J. Grant

(57) ABSTRACT

A bolt and nut engaging tool includes a loop that has an outer surface, an inner surface, a top side and a bottom side. The inner surface has a size and shape adapted for removably receiving a fastener. Each of a pair of the finger grips is coupled to the loop and extends in opposite directions with respect to each other. Each of the finger grips has an outer end extending away from the loop. The fastener may be removably positioned within the loop member so that the loop member engages the fastener and may be rotated by placing rotational force on the finger grips.

2 Claims, 4 Drawing Sheets

BOLT AND NUT ENGAGING TOOL

This application is a continuation of U.S. patent application Ser. No. 11/003,965 filed on Dec. 6, 2004 now U.S. Pat. No. 7,191,687.

BACKGROUND OF THE INVENTION

1. Field of the Invention

The present invention relates to wrench devices and more particularly pertains to a new wrench device for allowing the rotation of a bolt or nut with finger grips and which may be used within tight locales.

2. Description of the Prior Art

The use of wrench devices is known in the prior art. U.S. Pat. No. 5,287,775 describes a torque limiting wrench having a circular hand grip. Another type of wrench device is U.S. Pat. No. 5,005,448 which includes a circular handgrip having a plurality of cut outs therein for aiding the grip of the handgrip. Yet another such device is found in U.S. Pat. No. 6,138,531 which again includes a circular handgrip. This handgrip is scalloped for again aiding in gripping the handgrip.

While these devices fulfill their respective, particular objectives and requirements, the need remains for a wrench which may easily used by the fingers. This will aid a person who is attempting to loosen or tighten a fastener in a confined space which does not easily allow for an elongated handle or for the user's hand as would be required in the above devices. In particular, finger engaging members should be utilized to allow for rotation of a wrench using only fingers.

SUMMARY OF THE INVENTION

The present invention meets the needs presented above by generally comprising a loop that has an outer surface, an inner surface, a top side and a bottom side. The inner surface has a size and shape adapted for removably receiving a fastener. Each of a pair of the finger grips is coupled to the loop and extends in opposite directions with respect to each other. Each of the finger grips has an outer end extending away from the loop. The fastener may be removably positioned within the loop member so that the loop member engages the fastener and may be rotated by placing rotational force on the finger grips.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
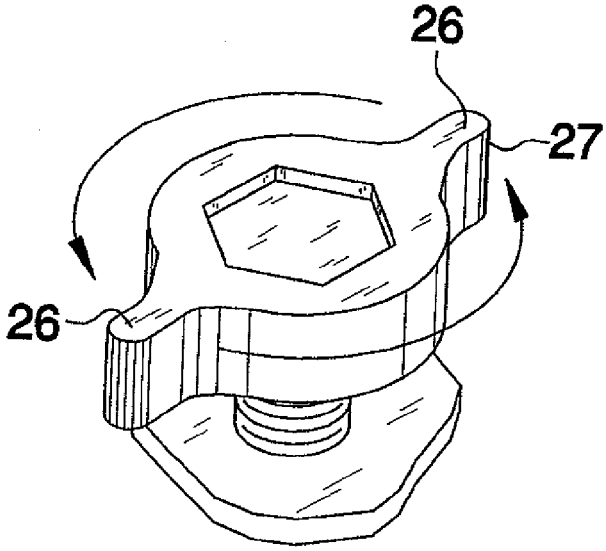
FIG. 1 is a perspective view of a first embodiment of a bolt and nut engaging tool according to the present invention.
Figure 2:
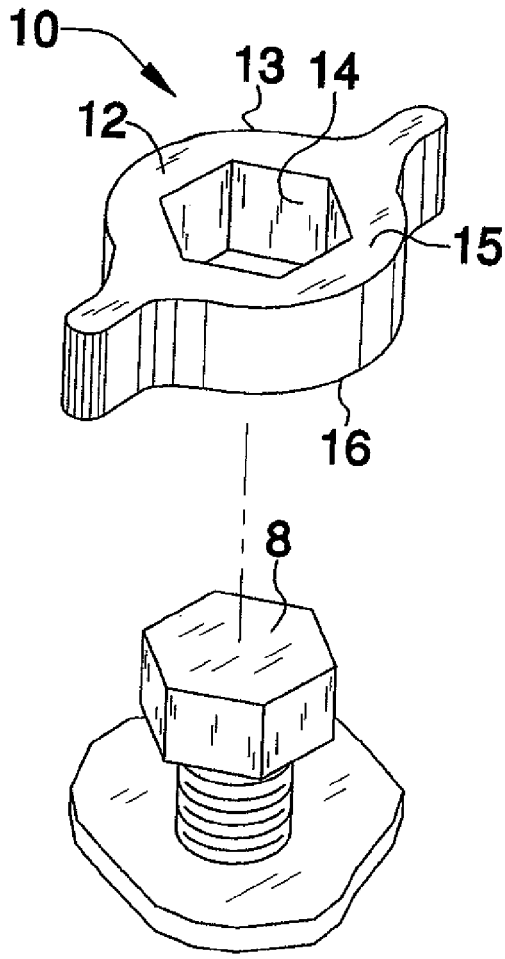
FIG. 2 is a perspective view of the first embodiment of the present invention.
Figure 3:
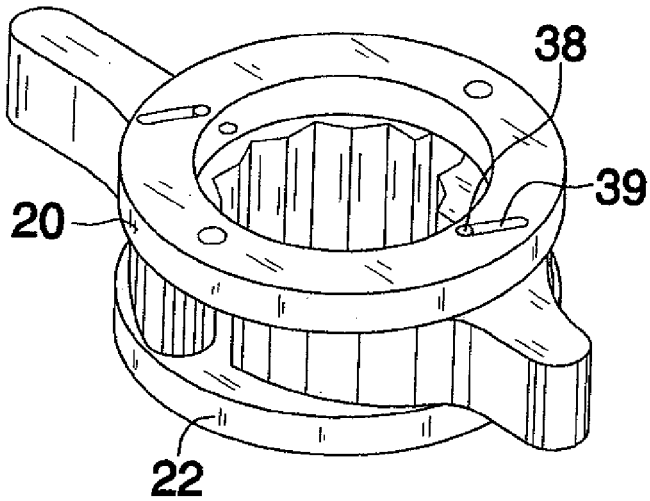
FIG. 3 is a perspective view of a second embodiment of the present invention.
Figure 4:
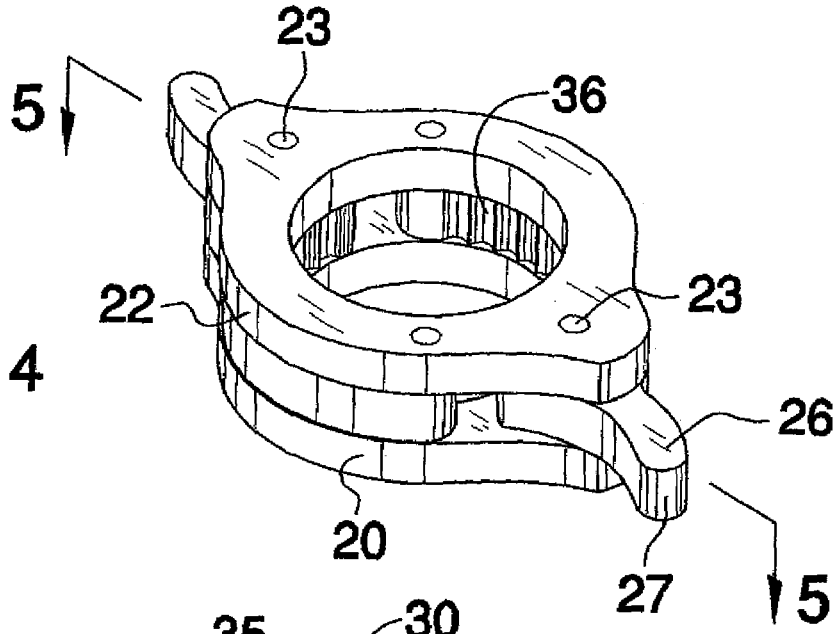
FIG. 4 is a perspective view of the present invention.
Figure 5:
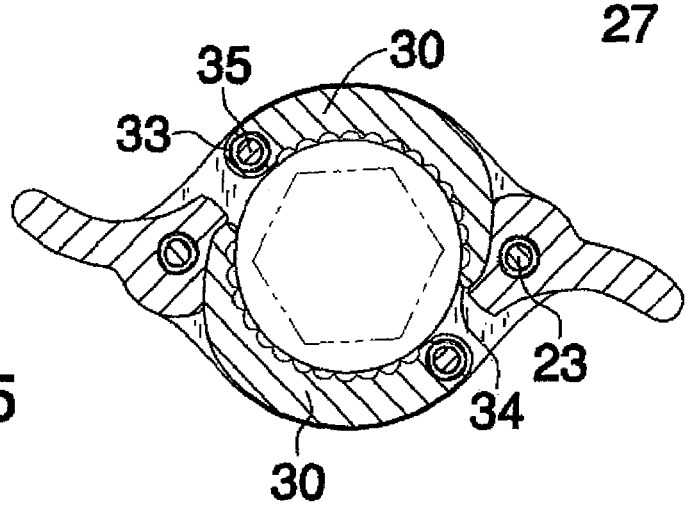
FIG. 5 is a cross-sectional view taken along line 5-5 of FIG. 4 of the second embodiment of the present invention.
Figure 6:
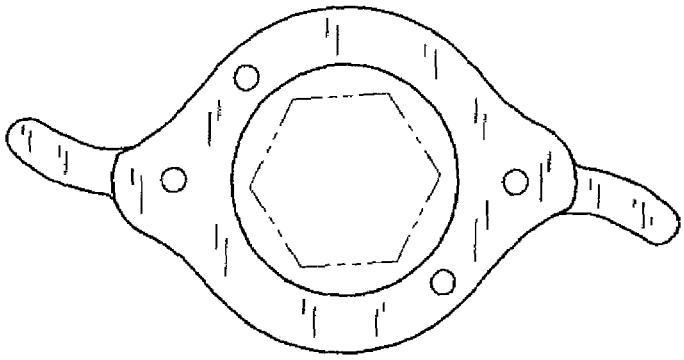
FIG. 6 is a bottom view of the second embodiment of the present invention.

With reference now to the drawings, and in particular to FIGS. 1 through 12 thereof, a new wrench device embodying the principles and concepts of the present invention and generally designated by the reference numeral 10 will be described.

Figure 9:
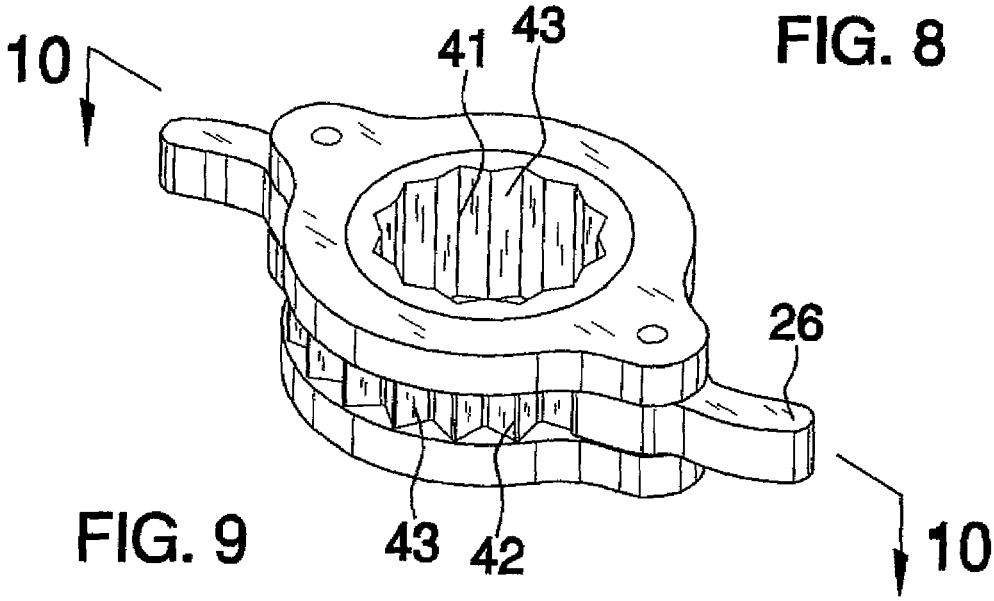
FIG. 9 is a perspective view of a third embodiment of the present invention.
Figure 10:
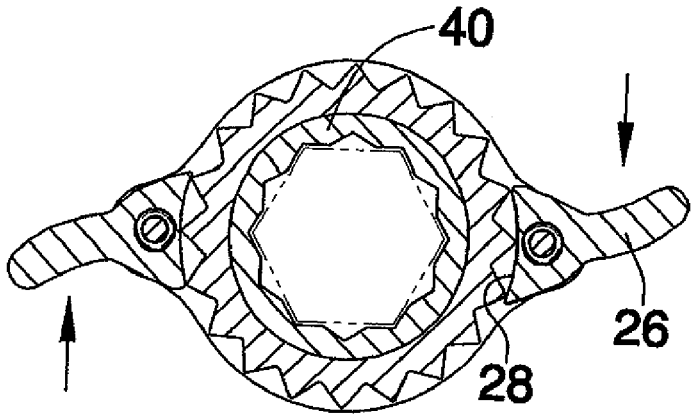
FIG. 10 is a cross-sectional view taken along line 10-10 of FIG. 9 of the present invention.

As best illustrated in FIGS. 1 through 12, the bolt and nut engaging tool 10 generally comprises a loop 12 that has an outer surface 13, an inner surface 14, a top side 15 and a bottom side 16. The inner surface 14 has a size and shape adapted for removably receiving a fastener 8. The fastener 8 generally includes bolt heads and nuts which are conventionally engaged with a wrench or socket. The loop 12 of a second embodiment, shown in FIGS. 3-8, and a third embodiment, shown in FIGS. 9-10, is divided along a plane orientated parallel to a plane of the top side such that an upper portion 20 and a lower portion 21 of the loop 12 is defined. The upper 20 and lower 22 portions are attached together by a pair of rods 23 so that the upper 20 and lower 22 portions are spaced from each other. The rods 23 are positioned opposite with respect to each other on the loop 12.

Figure 11:
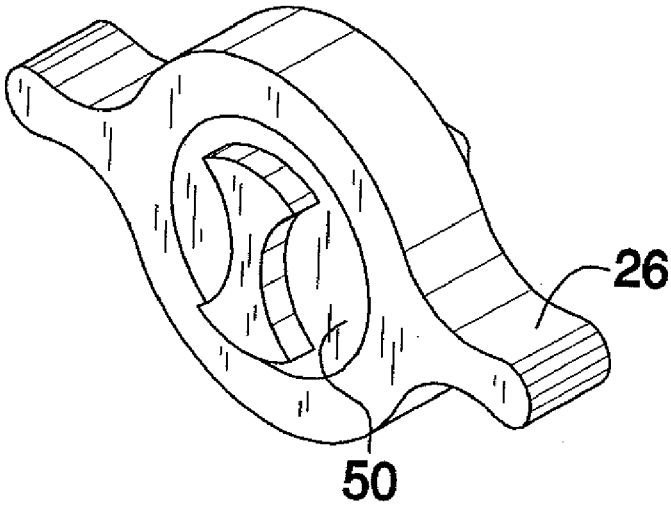
FIG. 11 is a front perspective view of a fourth embodiment of the present invention.
Figure 12:
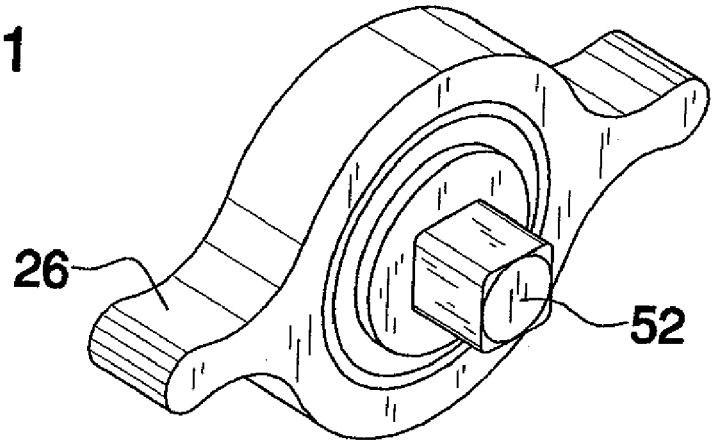
FIG. 12 is a back perspective view of the fourth embodiment of the present invention.

A pair of finger grips 26 is provided. The finger grips 26 are coupled to the loop 12 and extend in opposite directions with respect to each other. Each of the finger grips 26 has an outer end 27 extending away from the loop 12. The finger grips 26 of a first embodiment, shown in FIGS. 1-2, and a fourth embodiment, shown in FIGS. 11-12 are integrally coupled to the loop member 12. The finger grips 26 of the second and third embodiments are pivotally coupled to one of the rods 23. Each of the finger grips 26 of the second and third embodiments has an inner end 28 positioned between the upper 20 and lower 22 portions. The finger grips 26 are preferably slightly curved to add in their use. The finger grips 26 each have a length less than 2 inches.

The second embodiment includes a pair of arcuate gripping members 30. Each of the gripping members 30 has a concave edge 32. Each of the gripping members 30 is positioned between the lower 22 and upper 20 portions so that the concave edges 32 are generally facing each other.

Figure 7:
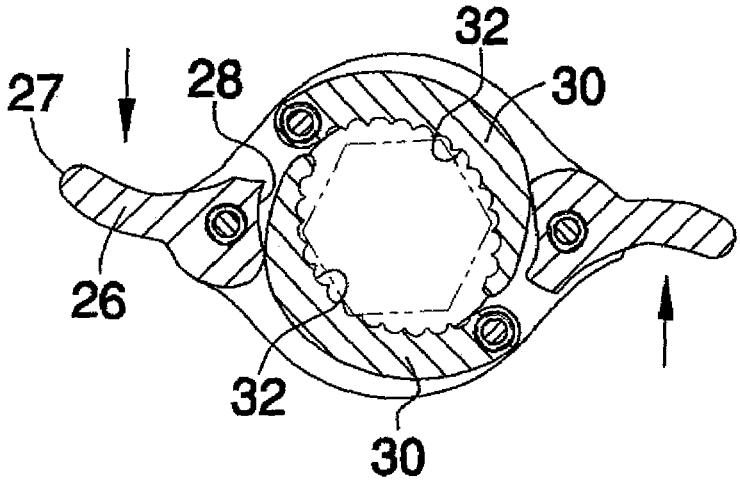
FIG. 7 is a cross-sectional view of the second embodiment of the present invention.
Figure 8:
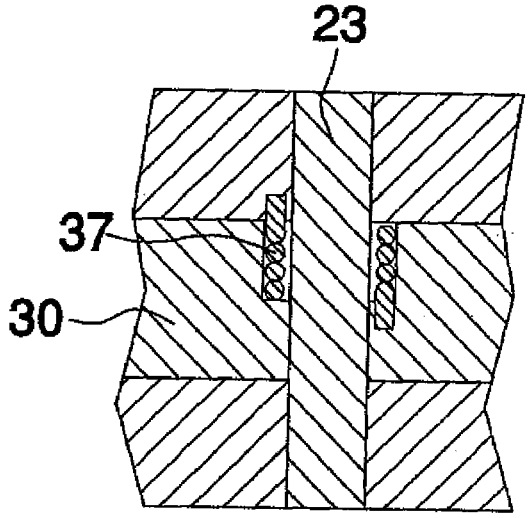
FIG. 8 is a cross-sectional view of the second embodiment of the present invention.

The gripping members 30 each have a first end 33 a second end 34. A pair axles 35 is attached to and extends between the upper 20 and lower 22 portions. Each of the axles 35 extends through one of the gripping members 30 and is positioned adjacent to a respective one of the first ends 33. The gripping members 30 are selectively positionable in a closed position wherein the second ends 34 are extended inward of the loop member 12 or in an open position wherein the second ends 34 are positioned between the upper 20 and lower 22 portions and the concave edges 32 extend along the inner edge 14 of the loop 12. Each of the inner ends 28 of the finger grips 26 abuts and extends along one of the gripping members 30 adjacent to the second ends 34. The inner edges 28 bias the second ends 34 inward when the outer ends 27 are selectively moved in a first direction with respect to the loop 12, as shown in FIG. 7. Each of the concave edges 32 has a plurality of teeth 36 therein. To use the second embodiment, the gripping members 30 are positioned in the closed position so that the gripping members 30 releasably engage the fastener 8 positioned within the loop 12. Springs 37 may be mounted on the axles 35 and coupled to the gripping members 30 for selectively biasing the second ends 34 of the gripping members 30 in the closed position. Pins 38 may be attached to the second ends 34 and extended into slots 39 in the loop 12 to prevent too great of movement of the gripping members 30.

To use the first embodiment, the nut or bolt head of a fastener 8 is extended into the loop 12 so that the fastener may be rotated. The inner surface 14 preferably has a hexagonal shape and will be provided in a plurality of sizes to accommodate variously sized fasteners.

The third embodiment includes a ring 40, instead of gripping members 30, that is rotatably coupled to and which is positioned between the upper 20 and lower 22 portions. The ring 40 is axially aligned with the loop 12. The ring 40 has an inner perimeter edge 41 and an outer perimeter edge 42. Each of the inner 41 and outer 42 perimeter edges has a plurality of notches 43 therein. The inner ends 28 of the finger grips 26 each define a pawl positioned for engaging the notches 43 in the outer perimeter edge 42 for selectively restricting or imparting rotation of the ring 40 with respect to the loop 12. The outer ends 27 of the finger grips 26 may be selectively moved simultaneously in a first direction or a second direction for imparting an oppositely directed movement in the ring 40 with respect to the outer ends 27 of the finger members 26. The fastener 8 is extended into the loop 12 so that the ring 40 may engage the fastener and may be rotated with the finger grips 40 to loosen or tighten the fastener.

The fourth embodiment further includes a ratchet assembly 50 that is mounted within the loop member 12. The ratchet assembly 50 is generally conventional and includes a male coupler 52 that is attached to and extends away from said ratchet assembly 50. The fourth embodiment is used as a conventional ratchet wherein a socket would be attached to the male coupler.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrench assembly including:

a loop having an outer surface, an inner surface, a top side and a bottom side, said inner surface having a size and shape adapted for removably receiving a fastener, said loop being divided along a plane orientated parallel to a plane of said top side such that an upper portion and a lower portion of said loop is defined, said upper and lower portion being attached together by a pair of rods such that said upper and lower portions are spaced from each other;

a pair of finger grips, said finger grips being coupled to said loop and extending in opposite directions with respect to each other, each of said finger grips having an outer end extending away from said loop, each of said finger grips being pivotally coupled to one of said rods, each of said finger grips having an inner end positioned between said upper and lower portions;

a ring being rotatably coupled to and being positioned between said upper and lower portions, said ring being axially aligned with said loop, said ring having an inner perimeter edge and an outer perimeter edge, each of said inner and outer perimeter edges having a plurality of notches therein;

each of said inner ends of said finger grips defining a pawl positioned for engaging said notches in said outer perimeter edge for selectively restricting or imparting rotation of said ring with respect to said loop, wherein said outer ends of said finger grips may be selectively moved simultaneously in a first direction or a second direction for imparting an oppositely directed movement in said ring; and wherein the fastener may be removably positioned within said loop member such fastener is engaged by the loop member.

2. The wrench assembly according to claim 1, wherein said rods being spaced from each other.

* * * * *